US009675993B2

(12) United States Patent
Burns

(10) Patent No.: US 9,675,993 B2
(45) Date of Patent: Jun. 13, 2017

(54) COATING APPLICATOR AND COATING APPLICATION SYSTEM

(71) Applicant: Rooftop Research, LLC, New Wilmington, PA (US)

(72) Inventor: Robert S. Burns, New Wilmington, PA (US)

(73) Assignee: Rooftop Research, LLC, New Wilmington, PA (US)

( * ) Notice: Subject to any disclaimer, the term of this patent is extended or adjusted under 35 U.S.C. 154(b) by 385 days.

(21) Appl. No.: 14/197,800

(22) Filed: Mar. 5, 2014

(65) Prior Publication Data

US 2015/0251206 A1 Sep. 10, 2015

(51) Int. Cl.
*B05C 1/08* (2006.01)
*B05C 17/02* (2006.01)

(52) U.S. Cl.
CPC ..... *B05C 17/0212* (2013.01); *B05C 17/0217* (2013.01); *B05C 17/0232* (2013.01); *B05C 17/022* (2013.01)

(58) Field of Classification Search
CPC ..... B05C 17/0212; B05C 17/2017; B05C 17/0232; B05C 17/022
See application file for complete search history.

(56) References Cited

U.S. PATENT DOCUMENTS 2,538,241 A 1/1951 Guimond
2,823,402 A 2/1958 Phillips
2,929,089 A 3/1960 Nall
3,089,180 A 5/1963 Humphrey
3,332,131 A 7/1967 Weiler
3,662,422 A 5/1972 Christensen et al.
3,702,739 A * 11/1972 Rentfrow ..... A45D 34/041 15/230.11
3,714,674 A 2/1973 Simoncioni
3,717,899 A 2/1973 Gardner et al.
3,752,109 A 8/1973 Seiple
3,970,396 A 7/1976 Brady
4,573,233 A 3/1986 Stoop
5,198,036 A * 3/1993 Sotolongo ..... A47L 13/11 134/6
5,410,773 A 5/1995 Forkner
5,611,100 A * 3/1997 Zigelboim ..... B05C 17/0205 15/230.11
6,941,632 B1 * 9/2005 Mead ..... B29C 70/342 156/349
8,888,670 B2 * 11/2014 Grubbs ..... B26B 25/005 492/13
2005/0050665 A1 * 3/2005 Mitchell ..... B05C 17/0207 15/230.11
2006/0099025 A1 * 5/2006 Hann ..... B05C 17/0212 401/197
2011/0097485 A1 * 4/2011 Breeden ..... B05B 7/1486 427/186

* cited by examiner

*Primary Examiner* — Dung Van Nguyen
(74) *Attorney, Agent, or Firm* — The Webb Law Firm

(57) ABSTRACT

A coating applicator that applies a coating or liquid to a variety of different substrates having different contoured surfaces is disclosed. A coating applicator of the present disclosure is able to reach, contact, and cover the entirety of a contoured substrate. In this manner, the coating applicator is able to transfer a coating to the entirety of the contoured substrate.

8 Claims, 16 Drawing Sheets

COATING APPLICATOR AND COATING APPLICATION SYSTEM

BACKGROUND OF THE INVENTION

1. Field of the Disclosure

The present disclosure relates generally to a coating applicator. More particularly, the present disclosure relates to a coating applicator and a coating application system for applying a coating to a substrate.

2. Description of the Related Art

Rollers are used to apply paints and other liquids to a desired surface. Rollers hold a liquid on the outer surface or nap of the roller until it is desired to apply such liquids. As a roller is placed in contact with a substrate, the liquid is transferred from the outside of the roller to the contacted substrate. However, when the substrate is channeled, corrugated, or ribbed such surface irregularities prevent the surface of the roller from contacting the substrate to be coated.

For example, a roof panel that is formed with ribs and channels will have a surface that is undulated. As a conventional roller is used with such a surface, the liquid cannot be adequately transferred from the roller to the substrate because the roller cannot contact all of the areas of the substrate or roof panel. The areas of the substrate that are not contacted by the roller do not receive the liquid. This results in many areas of the substrate being uncovered by the liquid.

To attempt to coat these uncovered areas of the substrate, the roller must be placed in awkward orientations to try to transfer the coating from the roller to the substrate. This method of application makes the process of coating a channeled surface very difficult. This process is time consuming and often it is impossible to reach all of the surfaces to be coated. Furthermore, the person maneuvering the roller is placed in danger as they attempt to orient the roller to the channeled surface.

SUMMARY OF THE INVENTION

The present disclosure provides a coating applicator that applies a coating or liquid to a variety of different substrates having different contoured surfaces. The present disclosure provides a coating applicator that is able to reach, contact, and cover the entirety of a contoured substrate. In this manner, the coating applicator is able to transfer a coating to the entirety of the contoured substrate.

In accordance with an embodiment of the present disclosure, a coating applicator for applying a coating to a substrate includes a body having a first portion and a second portion, the first portion having a first diameter and the second portion having a second diameter less than the first diameter.

In one configuration, the first portion includes a first section and a second section and the second portion is between the first section and the second section. In another configuration, the body includes a third portion between the first portion and the second portion. In yet another configuration, the third portion is tapered. In one configuration, the coating applicator comprises a roller. In another configuration, the substrate has a first contoured surface and a second contoured surface different than the first contoured surface, the first portion of the coating applicator is adapted to cover the first contoured surface of the substrate and the second portion of the coating applicator is adapted to cover the second contoured surface of the substrate. In yet another configuration, the coating applicator includes a nap material removably attachable to the body of the coating applicator, the nap material adapted to receive the coating and apply the coating to the substrate. In one configuration, the nap material is transitionable between an undeformed position and a deformed position in which the nap material is adapted to variably cover the substrate.

In accordance with another embodiment of the present disclosure, a coating applicator for applying a coating to a substrate includes a body having a first portion and a second portion, the first portion having a first contoured surface and the second portion having a second contoured surface different than the first contoured surface.

In one configuration, the substrate has a first substrate contoured surface and a second substrate contoured surface different than the first substrate contoured surface, the first portion of the coating applicator is adapted to cover the first substrate contoured surface and the second portion of the coating applicator is adapted to cover the second substrate contoured surface.

In accordance with another embodiment of the present disclosure, a coating applicator for applying a coating to a substrate includes a body having a first portion, a second portion, and a third portion, the first portion having a first contoured surface, the second portion having a second contoured surface, and the third portion having a third contoured surface, the third contoured surface different than the second contoured surface and the first contoured surface, and the second contoured surface different than the first contoured surface.

In one configuration, the substrate has a first substrate contoured surface, a second substrate contoured surface different than the first substrate contoured surface, and a third substrate contoured surface different than the first substrate contoured surface and the second substrate contoured surface, the first portion of the coating applicator is adapted to cover the first substrate contoured surface, the second portion of the coating applicator is adapted to cover the second substrate contoured surface, and the third portion of the coating applicator is adapted to cover the third substrate contoured surface.

In accordance with another embodiment of the present disclosure, a coating applicator for applying a coating to a substrate having a first contoured surface and a second contoured surface different than the first contoured surface includes a body having a first portion and a second portion, the first portion having a first diameter and the second portion having a second diameter less than the first diameter, the first portion adapted to cover the first contoured surface of the substrate and the second portion adapted to cover the second contoured surface of the substrate.

In accordance with another embodiment of the present disclosure, a coating application system for applying a coating to a substrate includes a carrier; a first coating applicator for applying the coating to the substrate, the first coating applicator removably attachable to the carrier, the first coating applicator comprising a first body having a first portion and a second portion, the first portion having a first diameter and the second portion having a second diameter different than the first diameter; and a second coating applicator for applying the coating to the substrate, the second coating applicator removably attachable to the carrier, the second coating applicator comprising a second body having a third portion and a fourth portion, the third portion having a third diameter and the fourth portion having a fourth diameter different than the third diameter.

In one configuration, the first diameter of the first portion of the first coating applicator is different than the third diameter of the third portion of the second coating applicator. In another configuration, the second diameter of the second portion of the first coating applicator is different than the fourth diameter of the fourth portion of the second coating applicator. In yet another configuration, the carrier includes a movable support for transporting the carrier along the substrate. In one configuration, the movable support comprises a wheel. In another configuration, the carrier comprises a tank spreader. In yet another configuration, the carrier comprises a frame and a handle extending from the frame. In one configuration, the substrate has a first contoured surface and a second contoured surface different than the first contoured surface, the first portion of the first coating applicator is adapted to cover the first contoured surface of the substrate and the second portion of the first coating applicator is adapted to cover the second contoured surface of the substrate. In another configuration, the substrate has a first contoured surface and a second contoured surface different than the first contoured surface, the third portion of the second coating applicator is adapted to cover the first contoured surface of the substrate and the fourth portion of the second coating applicator is adapted to cover the second contoured surface of the substrate.

In accordance with another embodiment of the present disclosure, a coating application system for applying a coating to a substrate includes a carrier; a first coating applicator for applying the coating to the substrate, the first coating applicator removably attachable to the carrier, the first coating applicator comprising a first body having a first portion and a second portion, the first portion having a first contoured surface and the second portion having a second contoured surface different than the first contoured surface; and a second coating applicator for applying the coating to the substrate, the second coating applicator removably attachable to the carrier, the second coating applicator comprising a second body having a third portion and a fourth portion, the third portion having a third contoured surface and the fourth portion having a fourth contoured surface different than the third contoured surface.

In one configuration, the first contoured surface of the first portion of the first coating applicator is different than the third contoured surface of the third portion of the second coating applicator. In another configuration, the second contoured surface of the second portion of the first coating applicator is different than the fourth contoured surface of the fourth portion of the second coating applicator. In yet another configuration, the carrier includes a movable support for transporting the carrier along the substrate. In one configuration, the movable support comprises a wheel.

BRIEF DESCRIPTION OF THE DRAWINGS

The above-mentioned and other features and advantages of this disclosure, and the manner of attaining them, will become more apparent and the disclosure itself will be better understood by reference to the following descriptions of embodiments of the disclosure taken in conjunction with the accompanying drawings, wherein.

Corresponding reference characters indicate corresponding parts throughout the several views. The exemplifications set out herein illustrate exemplary embodiments of the disclosure, and such exemplifications are not to be construed as limiting the scope of the disclosure in any manner.

DETAILED DESCRIPTION

Figure 1A:
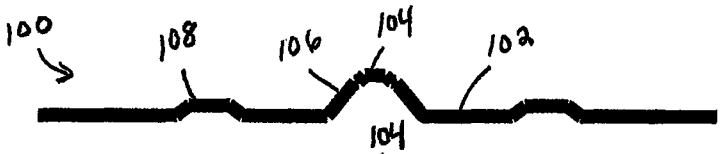
FIG. 1A is a cross-sectional view of a first substrate.
Figure 1B:
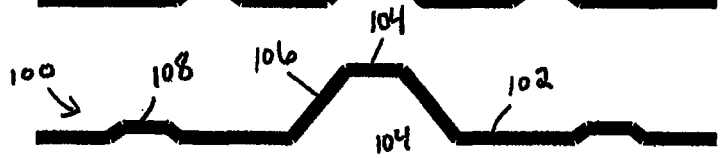
FIG. 1B is a cross-sectional view of a second substrate.
Figure 1C:
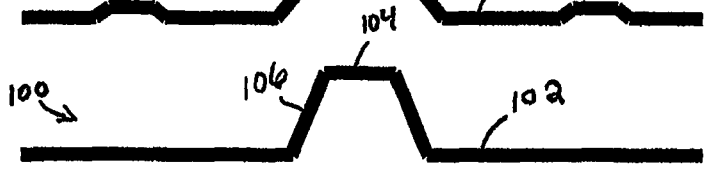
FIG. 1C is a cross-sectional view of a third substrate.
Figure 1D:
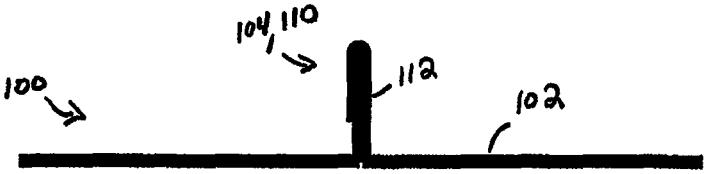
FIG. 1D is a cross-sectional view of a fourth substrate.

The following description is provided to enable those skilled in the art to make and use the described embodiments contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

For purposes of the description hereinafter, the terms "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations, except where expressly specified to the contrary. It is also to be understood that the specific devices illustrated in the attached drawings, and described in the following specification, are simply exemplary embodiments of the invention. Hence, specific dimensions and other physical characteristics related to the embodiments disclosed herein are not to be considered as limiting.

FIGS. 2A-16 illustrate exemplary embodiments of the present disclosure. The present disclosure provides a coating applicator that applies a coating or liquid to a variety of different substrates 100 having different contoured surfaces. The present disclosure provides a coating applicator that is able to reach, contact, and cover the entirety of a contoured substrate 100. In this manner, the coating applicator is able to transfer a coating to the entirety of the contoured substrate 100.

A coating applicator of the present disclosure is capable of applying to a substrate any coating material or liquid that will be beneficial to apply to a surface. For example, roof coatings include moisture cured urethane, two-part urethanes, acrylics, silicones, asphalt emulsions, elastomerics, primers, fibrated, not fibrated, liquefied EPDM, and various hybrids. These coatings often provide helpful benefits such as reducing thermal expansion and contraction as well as reducing indoor temperatures because of reflectivity. Other liquids may be used on other surfaces. For example, lubricants are often required to be applied to channeled or contoured surfaces. Aggregated asphaltic surfaces and concrete need their porous surfaces to be sealed with liquid sealers.

Figure 1E:
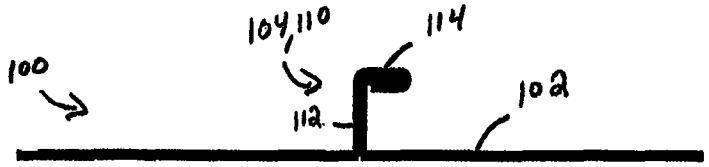
FIG. 1E is a cross-sectional view of a fifth substrate.
Figure 1F:
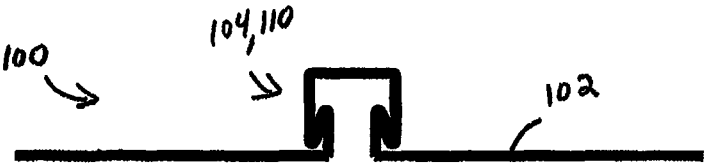
FIG. 1F is a cross-sectional view of a sixth substrate.
Figure 1G:
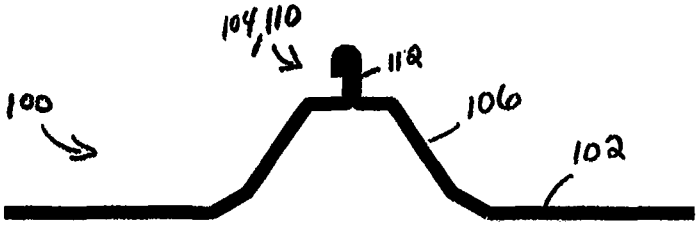
FIG. 1G is a cross-sectional view of a seventh substrate.

FIGS. 1A-1G illustrate exemplary substrates that can be completely covered by a coating applicator of the present disclosure. Referring to FIGS. 1A-1G, a substrate 100 includes a first contoured surface 102, a second contoured surface 104, and a third contoured surface 106. As shown in FIGS. 1A-1G, each of the contours of the first contoured surface 102, the second contoured surface 104, and the third contoured surface 106 are different. In some embodiments, a substrate 100 also includes a fourth contoured surface 108 as shown in FIG. 1A. In other embodiments, a substrate 100 includes a protruding element 110 that includes a vertical element 112 and a horizontal element 114 as shown in FIG. 1E.

Figure 17:
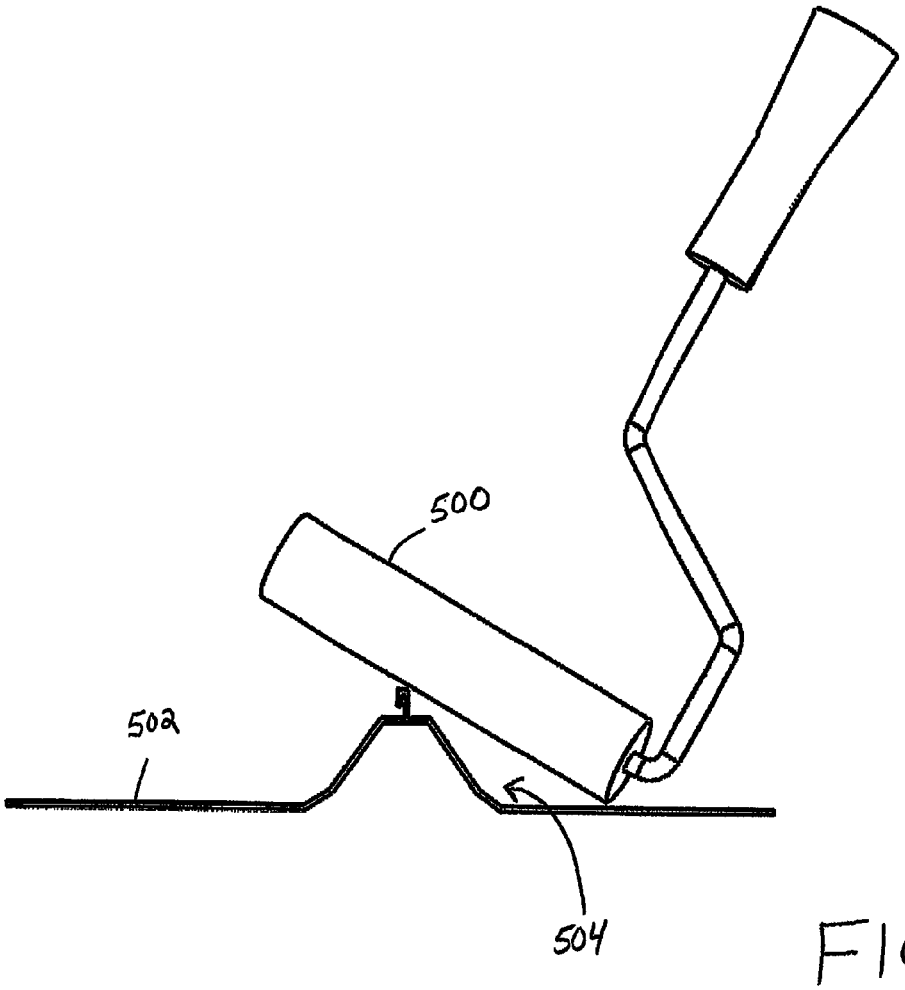
FIG. 17 PRIOR ART
FIG. 17 is an elevation view of a conventional roller illustrating the conventional roller not being able to contact all of the areas of a contoured substrate.

Disadvantageously, referring to FIG. 17, when a conventional roller 500 is used to apply a coating to a substrate 502 that is channeled, corrugated, or ribbed, the surface irregularities prevent the conventional roller 500 from contacting the substrate 502 to be coated. Thus, as a conventional roller 500 is used with such a substrate 502, the liquid cannot be adequately transferred from the conventional roller 500 to the substrate 502 because the conventional roller 500 cannot contact all of the areas of the substrate 502 or roof panel. The areas of the substrate 502 that are not contacted by the conventional roller 500, i.e., non-contacted areas 504, do not receive the liquid or coating. This results in many areas 504 of the substrate 502 being uncovered by the liquid or coating. The present invention solves such problems by providing a coating applicator that is able to reach, contact, and coat the entirety of such a contoured substrate.

Figure 2A:
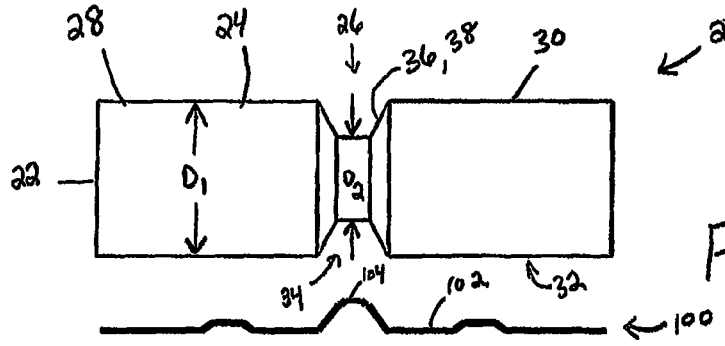
FIG. 2A is an elevation view of a first coating applicator in accordance with an embodiment of the present disclosure exploded from a substrate, the coating applicator adapted to reach, contact, and cover with a coating the various shapes, angles, contours, diameters, or small variations thereof of the contoured substrate.
Figure 12:
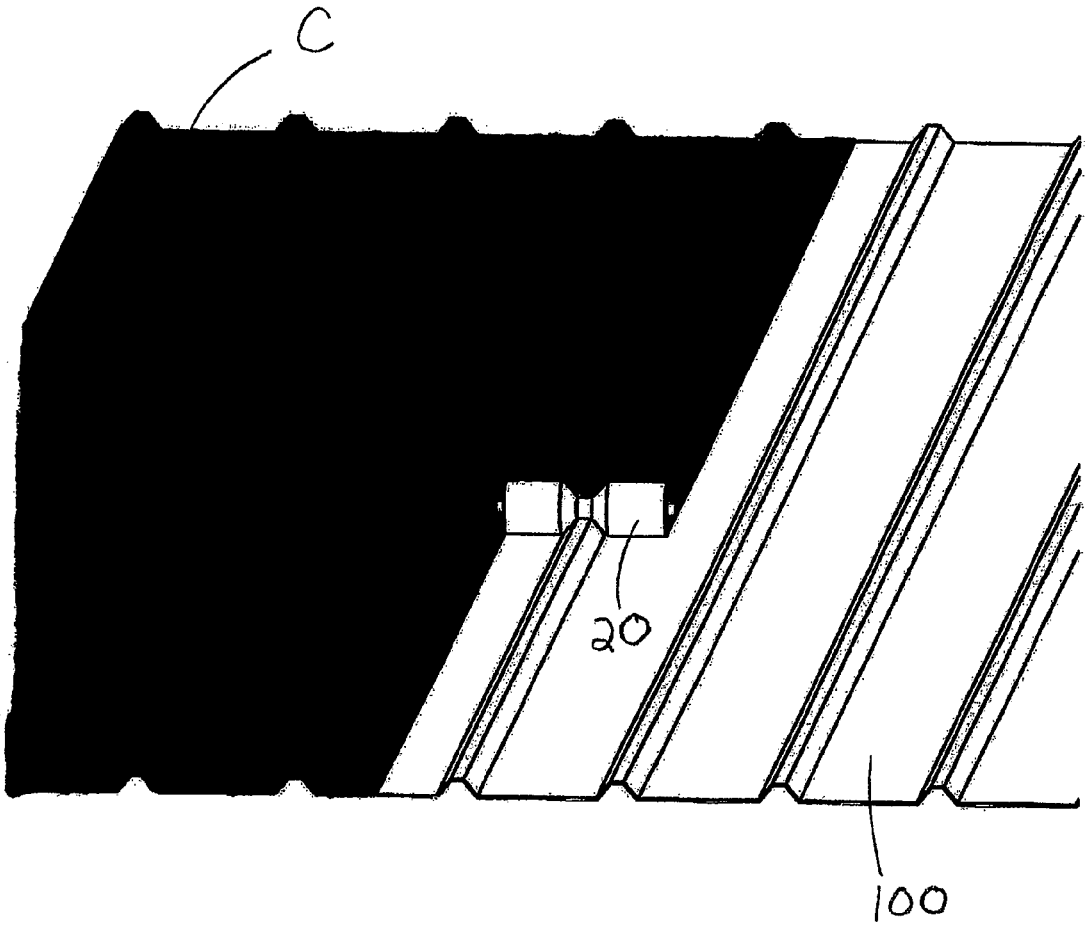
FIG. 12 is a perspective view of a coating applicator applying a coating to a substrate in accordance with an embodiment of the present disclosure.

Referring to FIG. 2A, a coating applicator 20 for applying a coating C (FIG. 12) to a substrate 100 includes a body 22 having a first portion 24 and a second portion 26. The first portion 24 of coating applicator 20 includes a first section 28 and a second section 30 and the second portion 26 is located between the first section 28 and the second section 30 of the first portion 24. In one embodiment, the first portion 24 of coating applicator 20 has a first diameter D1 and the second portion 26 has a second diameter D2 that is less than the first diameter D1. By having a coating applicator 20 that includes portions having different diameters, the first portion 24 of the coating applicator 20 is able to cover the first contoured surface 102 of the substrate 100 and the second portion 26 of the coating applicator 20 is able to cover the second contoured surface 104 of the substrate 100. In this manner, the coating applicator 20 is able to contact the entirety of a substrate 100 having different contoured surfaces. Thus, a coating applicator 20 of the present disclosure is able to transfer a coating C to the entirety of the contoured substrate 100 as shown in FIG. 12. In one embodiment, the coating applicator 20 is a roller.

In one embodiment, a coating applicator of the present disclosure may include a body having any combination of first and second diameters to correspond to any variety of first and second contoured surfaces of a substrate. In one embodiment, a coating applicator of the present disclosure may include any number of varying diameters to correspond to any number of varying contoured surfaces of a substrate.

Figure 6:
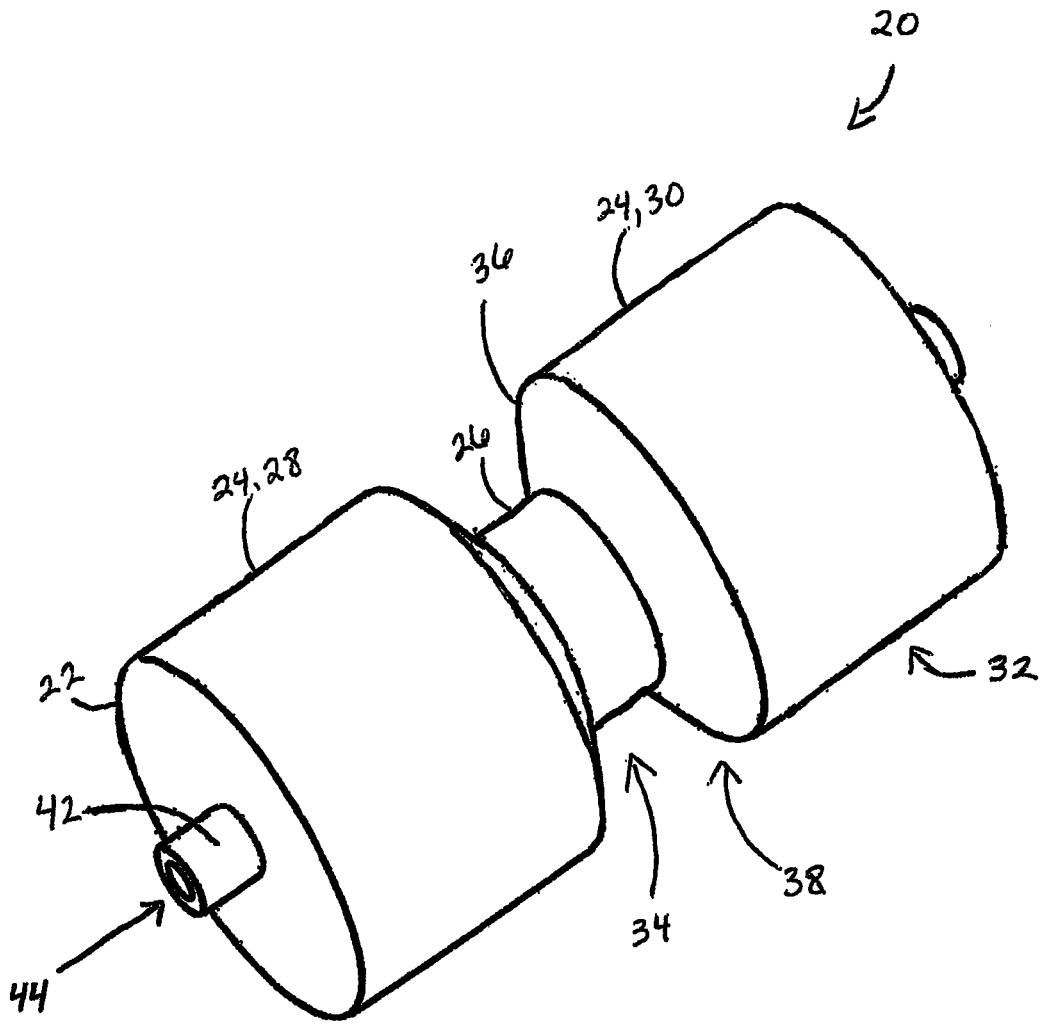
FIG. 6 is a perspective view of a coating applicator in accordance with an embodiment of the present disclosure.
Figure 7:
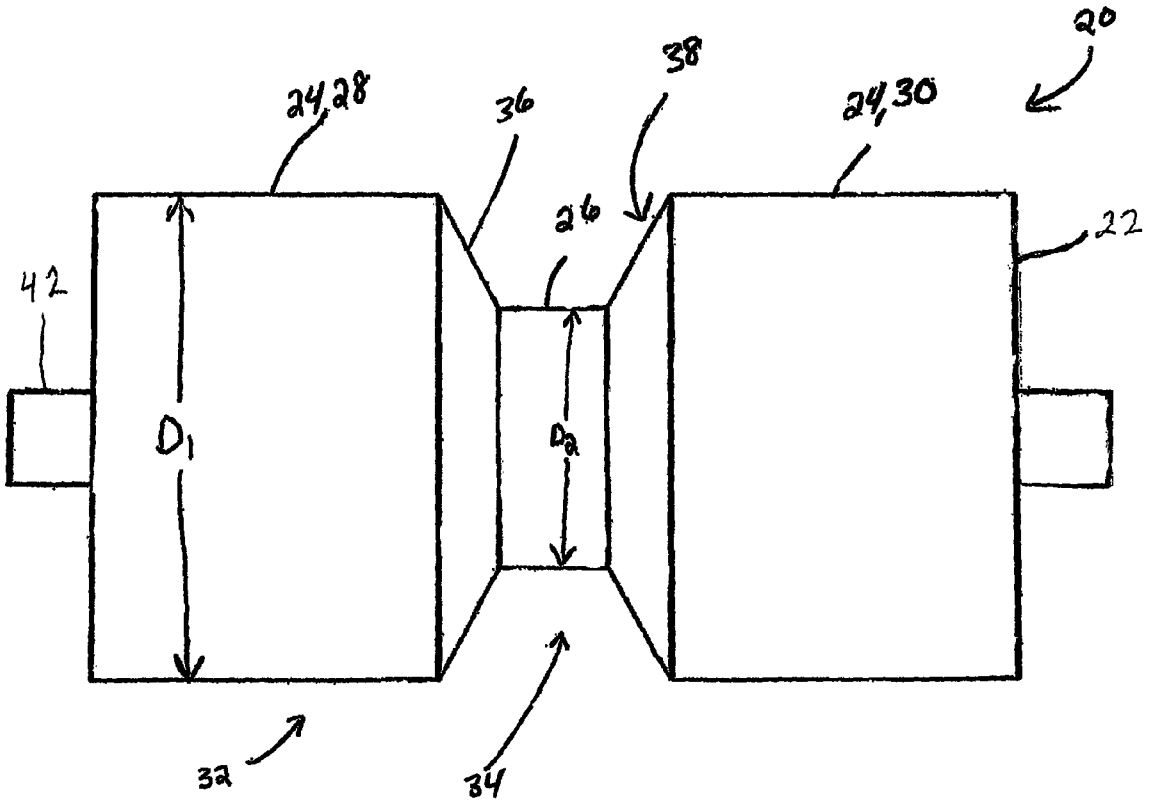
FIG. 7 is a front, elevation view of a coating applicator in accordance with an embodiment of the present disclosure.
Figure 13:
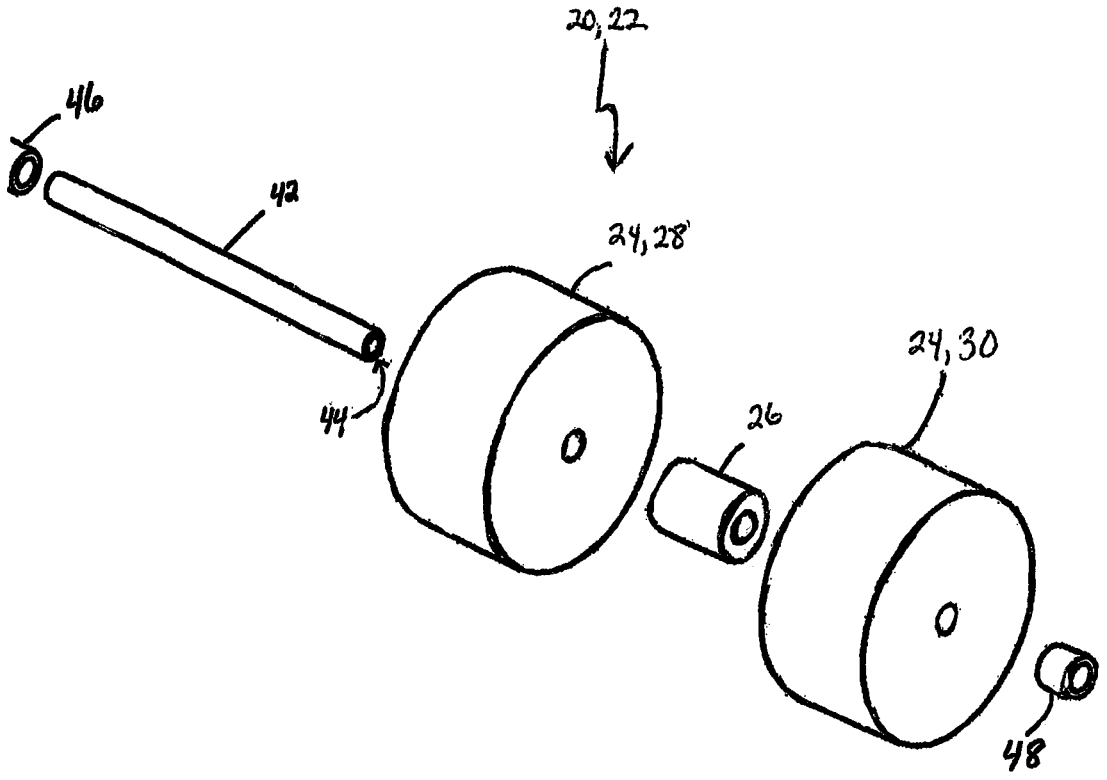
FIG. 13 is an exploded, perspective view of a coating applicator in accordance with an embodiment of the present disclosure.

Referring to FIGS. 6, 7, and 13, in one embodiment, the body 22 of the coating applicator 20 includes a central spool 42 defining an aperture 44 therethrough. The central spool 42 of the coating applicator 20 is configured to receive an axle member for rotatably connecting the coating applicator 20 to a carrier so that a user is able to conveniently apply a coating or a liquid to a substrate as will be described in more detail below.

Referring to FIG. 2A, in one embodiment, the first portion 24 of the coating applicator 20 has a first contoured surface 32 and the second portion 26 has a second contoured surface 34 that is different than the first contoured surface 32. By having a coating applicator 20 that includes portions having different contoured surfaces, the first portion 24 of the coating applicator 20 is able to cover the first contoured surface 102 of the substrate 100 and the second portion 26 of the coating applicator 20 is able to cover the second contoured surface 104 of the substrate 100. In this manner, the coating applicator 20 is able to contact the entirety of a substrate 100 having different contoured surfaces. Thus, a coating applicator 20 of the present disclosure is able to transfer a coating C to the entirety of the contoured substrate 100.

In one embodiment, a coating applicator of the present disclosure may include a body having any combination of geometric shapes to form two different first and second contoured surfaces to correspond to any variety of first and second contoured surfaces of a substrate. In one embodiment, a coating applicator of the present disclosure may include any number of different geometric shapes to correspond to any number of varying contoured surfaces of a substrate.

Referring to FIG. 2A, in one embodiment, the body 22 of the coating applicator 20 includes a third portion 36 that is located between the first portion 24 and the second portion 26. In one embodiment, the third portion 36 is tapered. The third portion 36 has a third contoured surface 38 that is different than the second contoured surface 34 and the first contoured surface 32.

By having a coating applicator 20 that includes portions having three different contoured surfaces, the first portion 24 of the coating applicator 20 is able to cover the first contoured surface 102 of the substrate 100, the second portion 26 of the coating applicator 20 is able to cover the second contoured surface 104 of the substrate 100, and the third portion 36 of the coating applicator 20 is able to cover the third contoured surface 106 of the substrate 100. In this manner, the coating applicator 20 is able to contact the entirety of a substrate 100 having three different contoured surfaces. Thus, a coating applicator 20 of the present disclosure is able to transfer a coating C to the entirety of the contoured substrate 100.

Figure 2B:
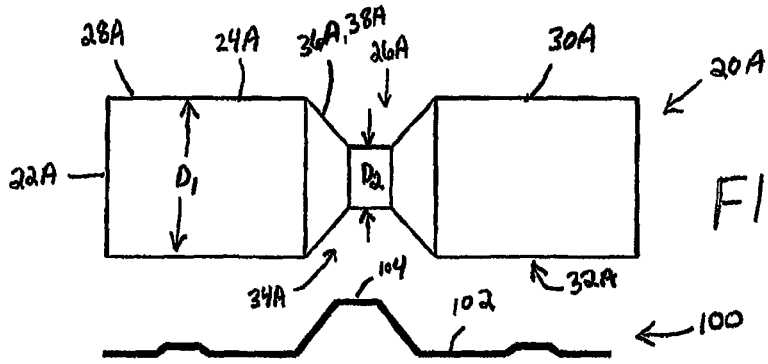
FIG. 2B is an elevation view of a second coating applicator in accordance with an embodiment of the present disclosure exploded from a substrate, the coating applicator adapted to reach, contact, and cover with a coating the various shapes, angles, contours, diameters, or small variations thereof of the contoured substrate.
Figure 2C:
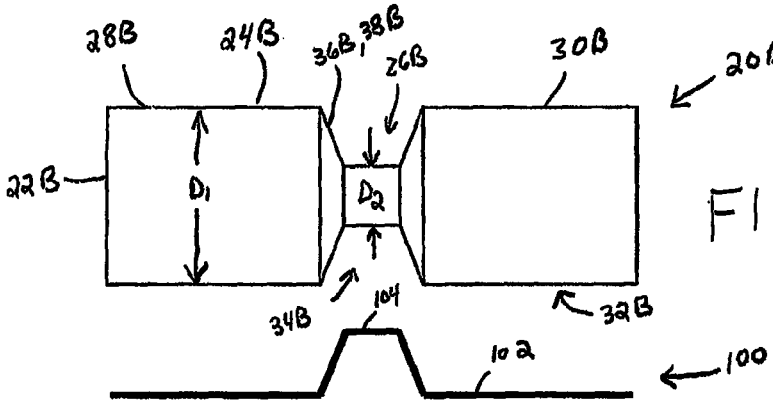
FIG. 2C is an elevation view of a third coating applicator in accordance with an embodiment of the present disclosure exploded from a substrate, the coating applicator adapted to reach, contact, and cover with a coating the various shapes, angles, contours, diameters, or small variations thereof of the contoured substrate.
Figure 2D:
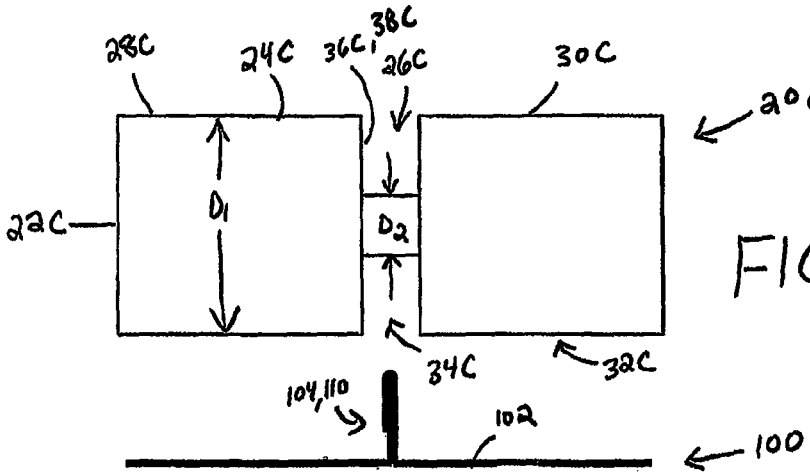
FIG. 2D is an elevation view of a fourth coating applicator in accordance with an embodiment of the present disclosure exploded from a substrate, the coating applicator adapted to reach, contact, and cover with a coating the various shapes, angles, contours, diameters, or small variations thereof of the contoured substrate.
Figure 2E:
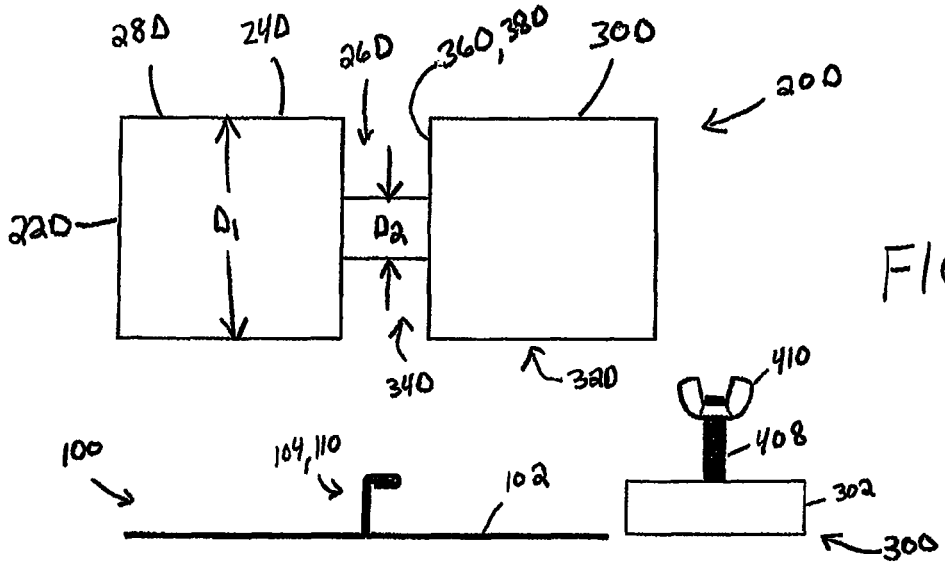
FIG. 2E is an elevation view of a fifth coating applicator in accordance with an embodiment of the present disclosure exploded from a substrate, the coating applicator adapted to reach, contact, and cover with a coating the various shapes, angles, contours, diameters, or small variations thereof of the contoured substrate.
Figure 3:
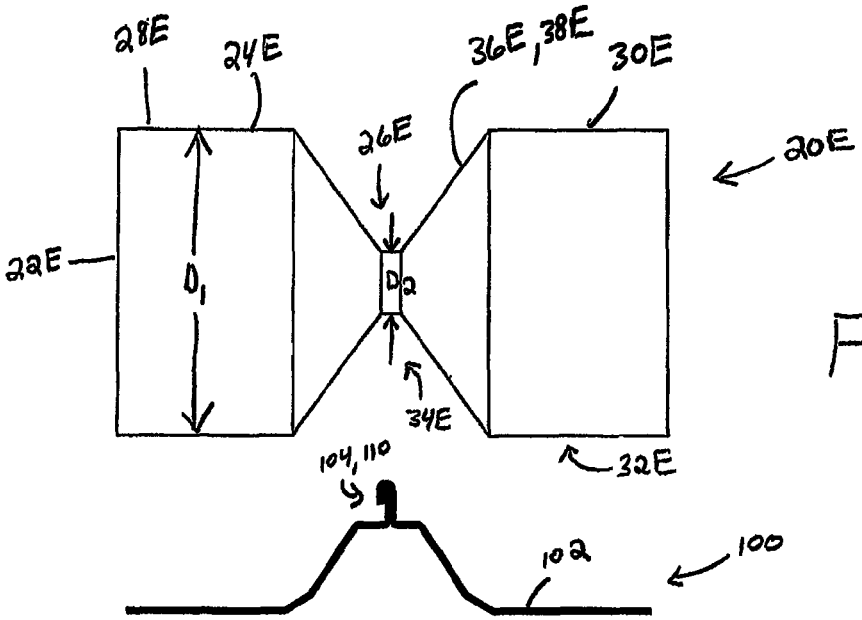
FIG. 3 is an elevation view of a sixth coating applicator in accordance with an embodiment of the present disclosure exploded from a substrate, the coating applicator adapted to reach, contact, and cover with a coating the various shapes, angles, contours, diameters, or small variations thereof of the contoured substrate.

FIGS. 2B-3 illustrate other exemplary embodiments of the present disclosure. The exemplary embodiment illustrated in FIG. 2B includes similar components to the embodiment illustrated in FIG. 2A, and the similar components are denoted by a reference number followed by the letter A. The exemplary embodiment illustrated in FIG. 2C includes similar components to the embodiment illustrated in FIG. 2A, and the similar components are denoted by a reference number followed by the letter B. The exemplary embodiment illustrated in FIG. 2D includes similar components to the embodiment illustrated in FIG. 2A, and the similar components are denoted by a reference number followed by the letter C. The exemplary embodiment illustrated in FIG. 2E includes similar components to the embodiment illustrated in FIG. 2A, and the similar components are denoted by a reference number followed by the letter D. The exemplary embodiment illustrated in FIGS. 3-5 includes similar components to the embodiment illustrated in FIG. 2A, and the similar components are denoted by a reference number followed by the letter E. For the sake of brevity, these similar components and the similar steps of using the other exemplary embodiments of the coating applicator will not all be discussed in conjunction with the embodiments illustrated in FIGS. 2B-3.

Figure 4:
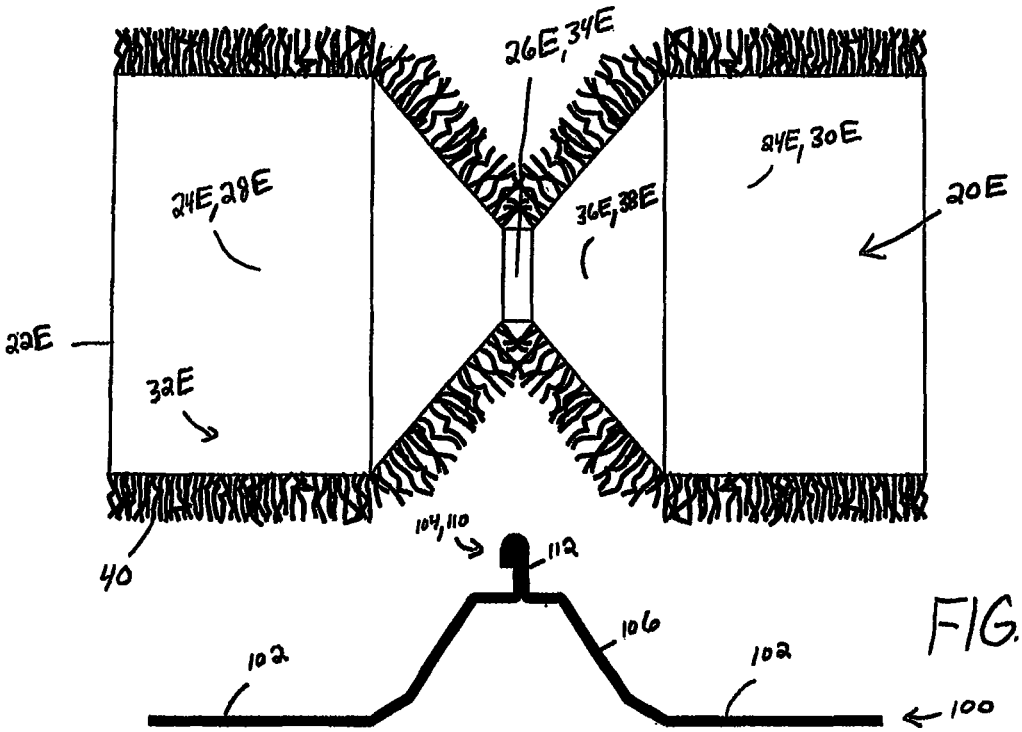
FIG. 4 is an elevation view of a coating applicator in accordance with an embodiment of the present disclosure exploded from a substrate, the coating applicator including a nap element in an undeformed position.
Figure 5:
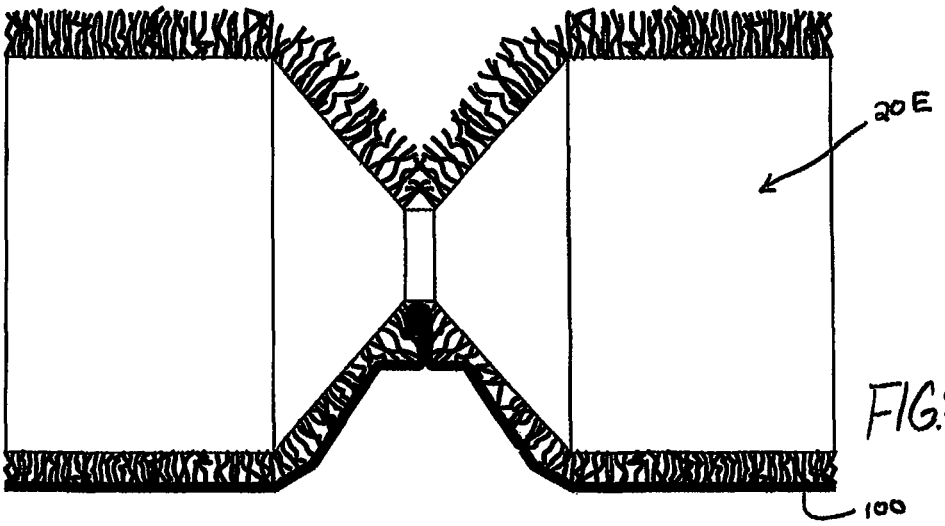
FIG. 5 is an elevation view of a coating applicator in accordance with an embodiment of the present disclosure in contact and covering a substrate, the coating applicator including a nap element in a deformed position.

Referring to FIGS. 3-5, with the coating applicator 20E in contact with the substrate 100, the first portion 24E of the coating applicator 20E covers the first substrate contoured surface 102, the second portion 26E of the coating applicator 20E is adapted to cover the second substrate contoured surface 104, and the third portion 36E of the coating applicator 20E is adapted to cover the third substrate contoured surface 106 as shown in FIG. 5. Thus, the coating applicator 20E is sized and shaped to match the contours of the substrate 100. In this manner, the coating applicator 20E is able to contact the entirety of a substrate 100 having different contoured surfaces. Thus, a coating applicator 20E of the present disclosure is able to transfer a coating to the entirety of the contoured substrate 100.

Referring to FIGS. 4 and 5, in one embodiment, the coating applicator 20E includes a nap element or material 40 removably attachable to the body 22E of the coating applicator 20E. The nap element 40 is able to receive and temporarily hold a coating C or liquid and is compressible to release a coating C or liquid onto a substrate when contacted. In this manner, with the coating C or liquid held in the nap element 40, the coating applicator 20E can be rolled over the surface of a substrate 100 thereby releasing the coating C or liquid onto the substrate 100. In one embodiment, the backing of the nap element 40 is rigid enough to maintain a shape when cut and formable enough to bend around various geometric shapes.

The nap element 40 is transitionable between an undeformed position as shown in FIG. 4 and a deformed position in which the nap element 40 is adapted to variably cover a substrate 100, i.e., the nap element 40 is able to cover many different contours of a substrate, as shown in FIG. 5. Referring to FIG. 5, as the coating applicator 20E contacts the substrate 100, the nap element 40 deforms such that the nap element 40 matches the contours of the substrate 100. For example, the nap element 40 deforms such that the nap element 40 is able to cover the vertical element 112 extending from the substrate 100. In this manner, the coating applicator 20E is able to contact the entirety of a substrate 100 having different contoured surfaces and elements extending therefrom. Thus, a coating applicator 20E of the present disclosure is able to transfer a coating to the entirety of the contoured substrate 100. In other words, the nap element 40 of the coating applicator 20E is sized and shaped such that the nap element 40 and the coating applicator 20E are able to reach, contact, and cover with a coating the various shapes, angles, contours, diameters, or small variations thereof of a contoured substrate. The nap element 40 provides the coating applicator 20E with the ability to contact and cover with a coating these varying geometric elements of a contoured substrate.

Referring to FIG. 2A, with a nap element 40 attached to the body 22 of the coating applicator 20, the coating applicator 20 would also be able to cover the fourth substrate contoured surface 108. As the coating applicator 20 contacts the substrate 100, the nap element 40 would deform more at the contact spot with the fourth substrate contoured surface 108 and less at the contact spot with the first substrate contoured surface 102. In this manner, the coating applicator 20 is able to contact the entirety of a substrate 100 having different contoured surfaces and elements extending therefrom. Thus, a coating applicator 20 of the present disclosure is able to transfer a coating to the entirety of the contoured substrate 100.

Referring to FIGS. 6-9, the connection of a coating applicator 20 of the present disclosure to a carrier will now be described. By connecting the coating applicator to a carrier, a user is able to conveniently maneuver the coating applicator to apply a coating or a liquid to a substrate.

Figure 8:
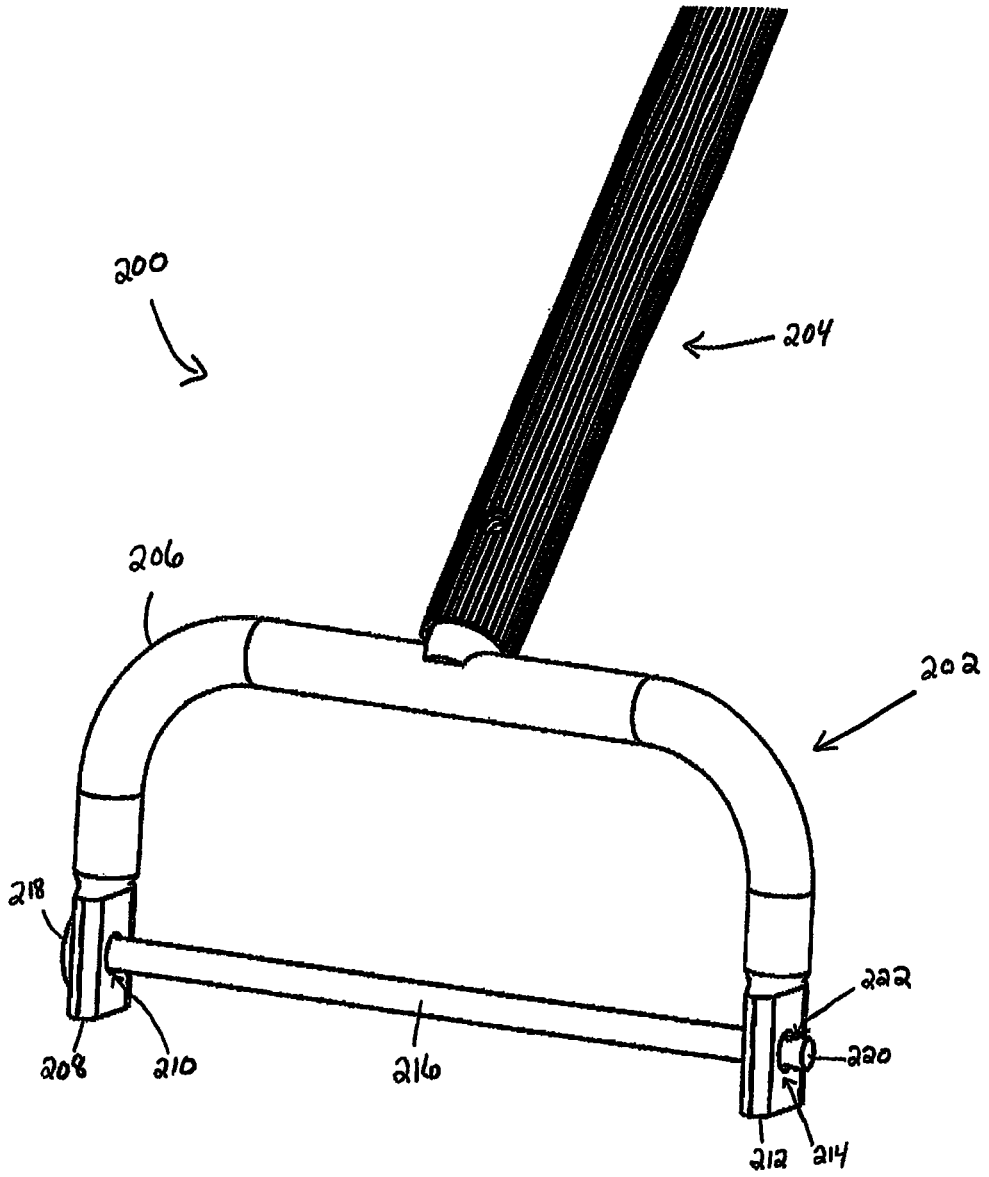
FIG. 8 is a perspective view of a carrier in accordance with an embodiment of the present disclosure.
Figure 9:
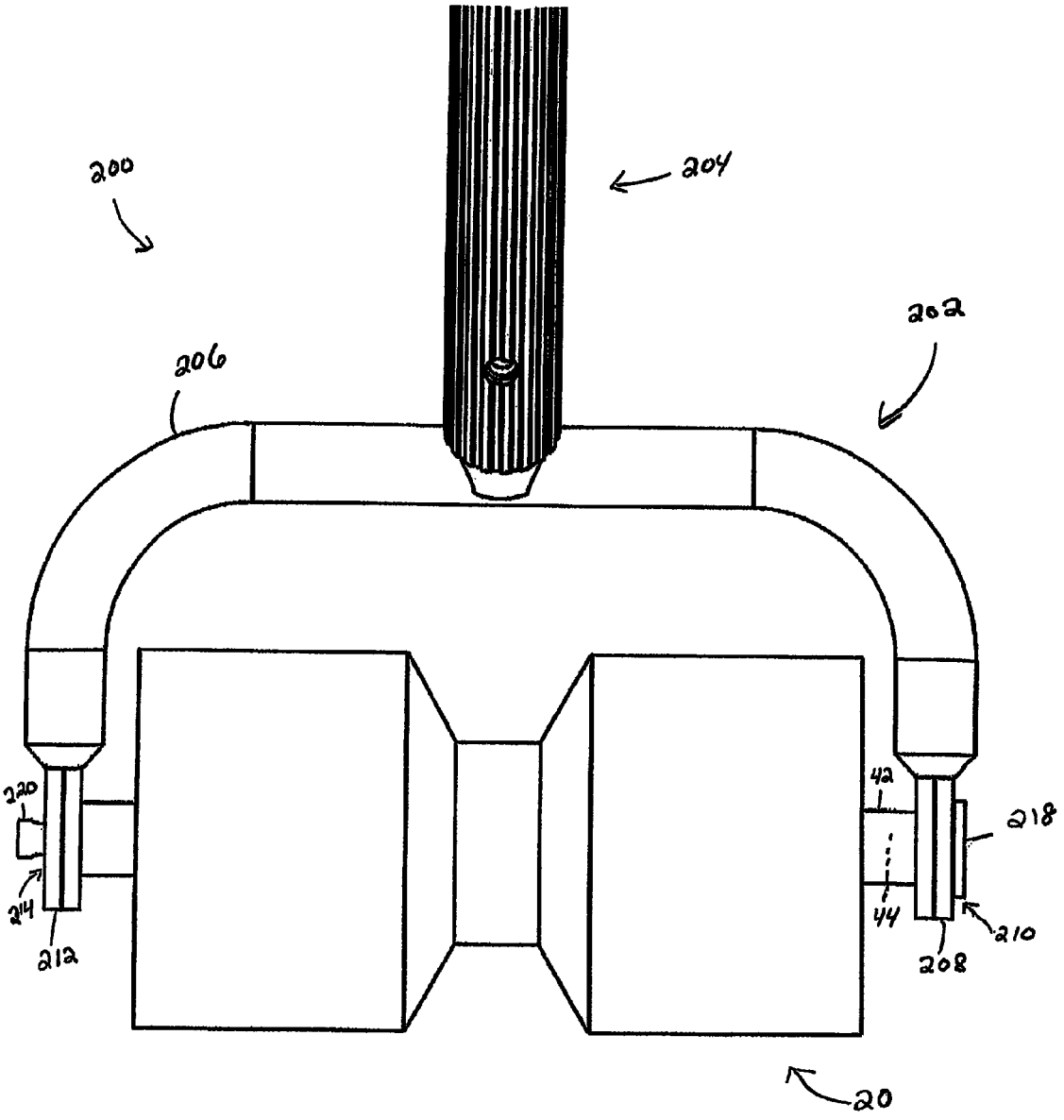
FIG. 9 is an elevation view of a coating applicator rotatably attached to a carrier in accordance with an embodiment of the present disclosure.

Referring to FIGS. 8 and 9, a carrier 200 includes a frame or applicator portion 202 and a handle portion 204 extending from the applicator portion 202. In one embodiment, the applicator portion 202 includes a generally U-shaped frame member 206 having a first frame end 208 defining a first bearing hole 210 and a second frame end 212 defining a second bearing hole 214. Each end 208, 212 of the frame member 206 defines a bearing hole 210, 214 for rotatably mounting a roller axle 216 to the frame member 206. The roller axle 216 includes a first end 218 and a second end 220 defining an aperture 222. In one embodiment, with the roller axle 216 rotatably mounted to the frame member 206 as shown in FIG. 8, a threaded fastener or similar fastener member may be secured to the second end 220 of the roller axle 216 to secure the roller axle 216 to the frame member 206. In other embodiments, a locking pin could be inserted into the aperture 222 of the second end 220 of the roller axle 216 to secure the roller axle 216 to the frame member 206.

Figure 10:
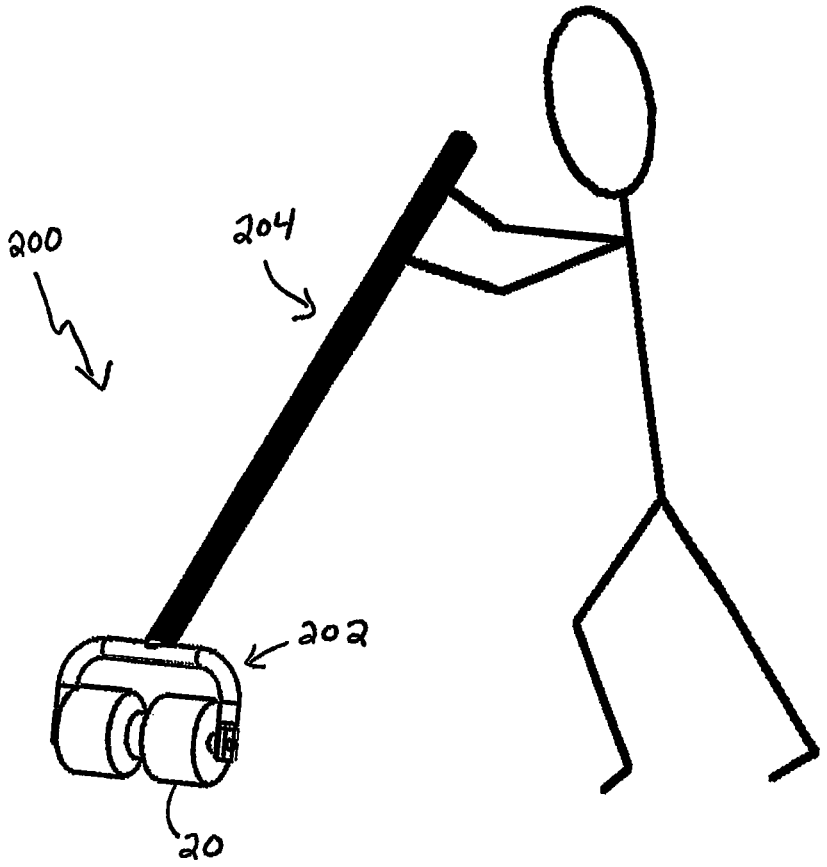
FIG. 10 is a perspective view of a coating applicator rotatably attached to a carrier and being maneuvered by a user in accordance with an embodiment of the present disclosure.

To rotatably secure a coating applicator 20 to the carrier 200, a coating applicator 20 is positioned between the first frame end 208 and the second frame end 212 of the frame member 206 of the carrier 200 as shown in FIG. 9. Next, a roller axle 216 is inserted through the first bearing hole 210 of the frame member 206 and then within the aperture 44 of the central spool 42 of the coating applicator 20 until the second end 220 of the roller axle 216 extends through the second bearing hole 214 as shown in FIG. 9. Next, a fastener may be secured to the second end 220 of the roller axle 216 to rotatably secure the coating applicator 20 and the roller axle 216 to the frame member 206. In this manner, the handle portion 204 of the carrier 200 can be used to conveniently move or roll a coating applicator 20 over a substrate to apply a coating or a liquid to the substrate as shown in FIG. 10. The connection between the coating applicator 20 and the carrier 200 is removable, such that, after use the coating applicator 20 is removable from the carrier 200.

Figure 11:
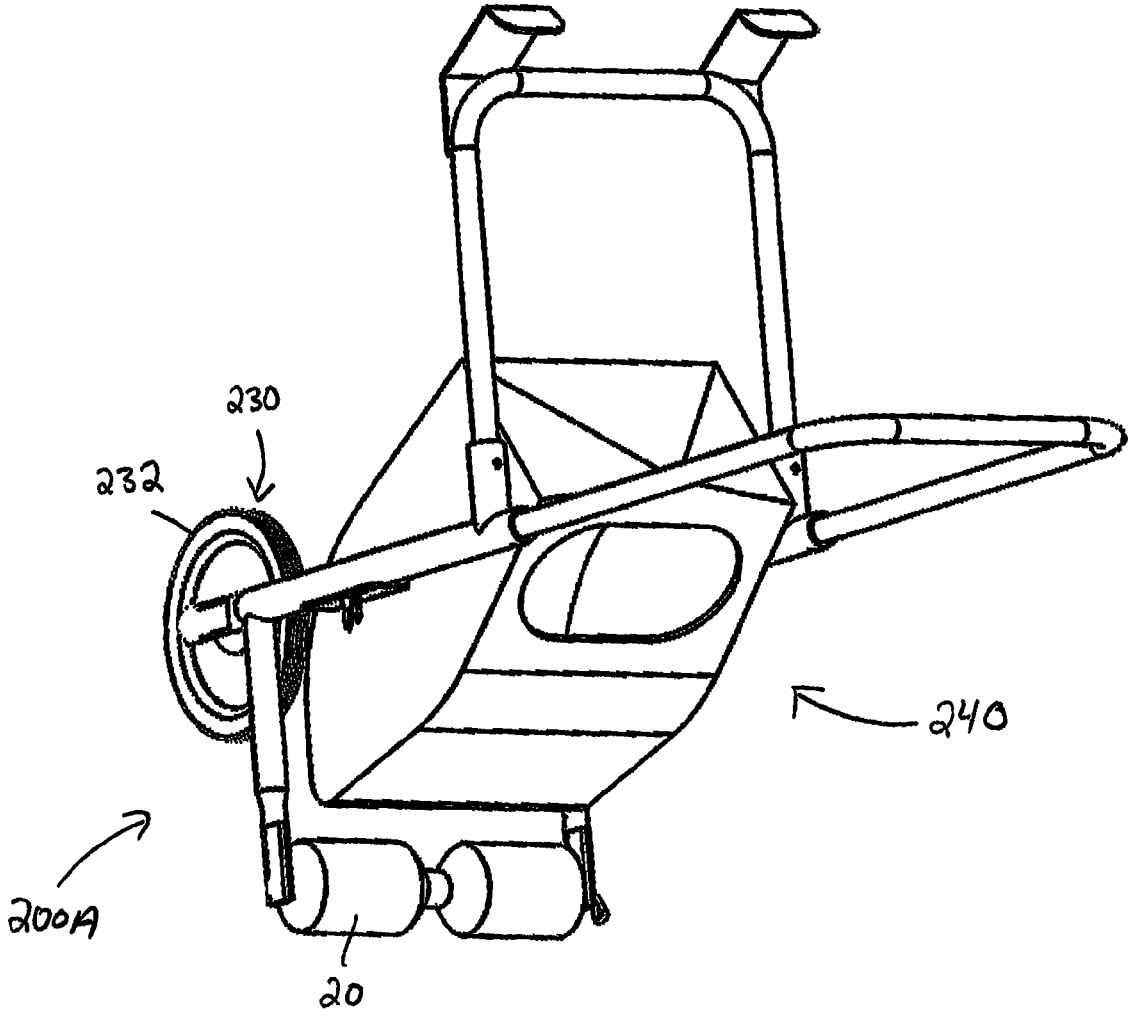
FIG. 11 is a perspective view of a coating applicator rotatably attached to a carrier in accordance with an embodiment of the present disclosure.

In one embodiment, a carrier 200A includes a movable support 230 for transporting the carrier 200A along a substrate as shown in FIG. 11. The movable support 230 may include a wheel 232 or a plurality of wheels. Referring to FIG. 11, in one embodiment, the carrier 200A includes a tank spreader 240.

The present disclosure provides a coating applicator system that is able to apply a coating or liquid to a variety of different substrates 100 having different contoured surfaces. The present disclosure provides a system that includes a first coating applicator that is able to contact the entirety of a first contoured substrate and a second coating applicator that is able to contact the entirety of a second contoured substrate that is different than the first contoured substrate. Because roof panels and other substrates have different shapes and contours as shown in FIGS. 1A-3, a system of the present disclosure allows a user to select a particular coating applicator for a desired coating project for a particular contoured substrate. In this manner, the system of the present disclosure allows any contoured substrate to be completely coated.

Referring to FIGS. 2A-3, any of the coating applicators can be removably attachable to a carrier such as carrier 200 as shown in FIGS. 9 and 10. Accordingly, a user may select any coating applicator to correspond to a particular contoured substrate and removably attach that coating applicator to a carrier. Once rotatably secured to the carrier, a user is able to conveniently apply a coating or a liquid to the entirety of a first contoured substrate. Upon completion, the user may remove the first coating applicator from the carrier. Next, if a differently contoured substrate needs to be coated, a user may then select a second coating applicator different than the first coating applicator and attach the second coating applicator to the carrier. Once rotatably secured to the carrier, a user is able to conveniently apply a coating or a liquid to the entirety of a second contoured substrate. Upon completion, the user may remove the second coating applicator from the carrier. In this manner, the system of the present disclosure allows any contoured substrate to be completely coated.

In one embodiment, for example, the system of the present disclosure includes a first coating applicator 20 (FIG. 2A) for applying a coating to a first substrate, the first coating applicator 20 removably attachable to the carrier, and the first coating applicator 20 having a first body 22 having a first portion 24 and a second portion 26, the first portion 24 having a first diameter D1 and the second portion 26 having a second diameter D2 different than the first diameter D1. The system of the present disclosure also includes a second coating applicator 20E (FIGS. 3-5) for applying a coating to a second substrate, the second coating applicator 20E removably attachable to the carrier, and the second coating applicator 20E having a second body 22E having a third portion 24E and a fourth portion 26E, the third portion 24E having a third diameter and the fourth portion 26E having a fourth diameter different than the third diameter. In one embodiment, the first diameter of the first portion 24 of the first coating applicator 20 is different than the third diameter of the third portion 24E of the second coating applicator 20E. In one embodiment, the second diameter of the second portion 26 of the first coating applicator 20 is different than the fourth diameter of the fourth portion 26E of the second coating applicator 20E.

Figure 15:
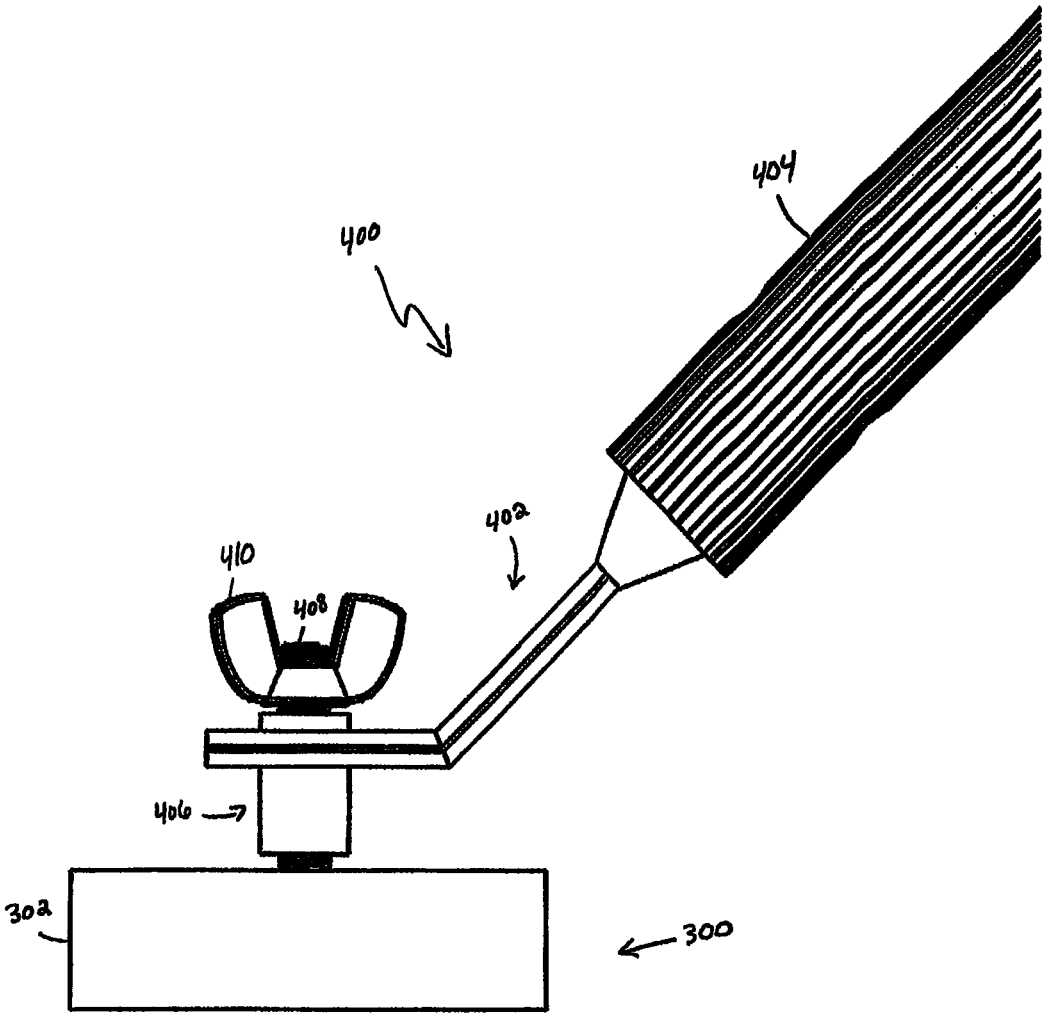
FIG. 15 is an assembled, elevation view of a coating applicator rotatably attached to a carrier in accordance with an embodiment of the present disclosure.
Figure 16:
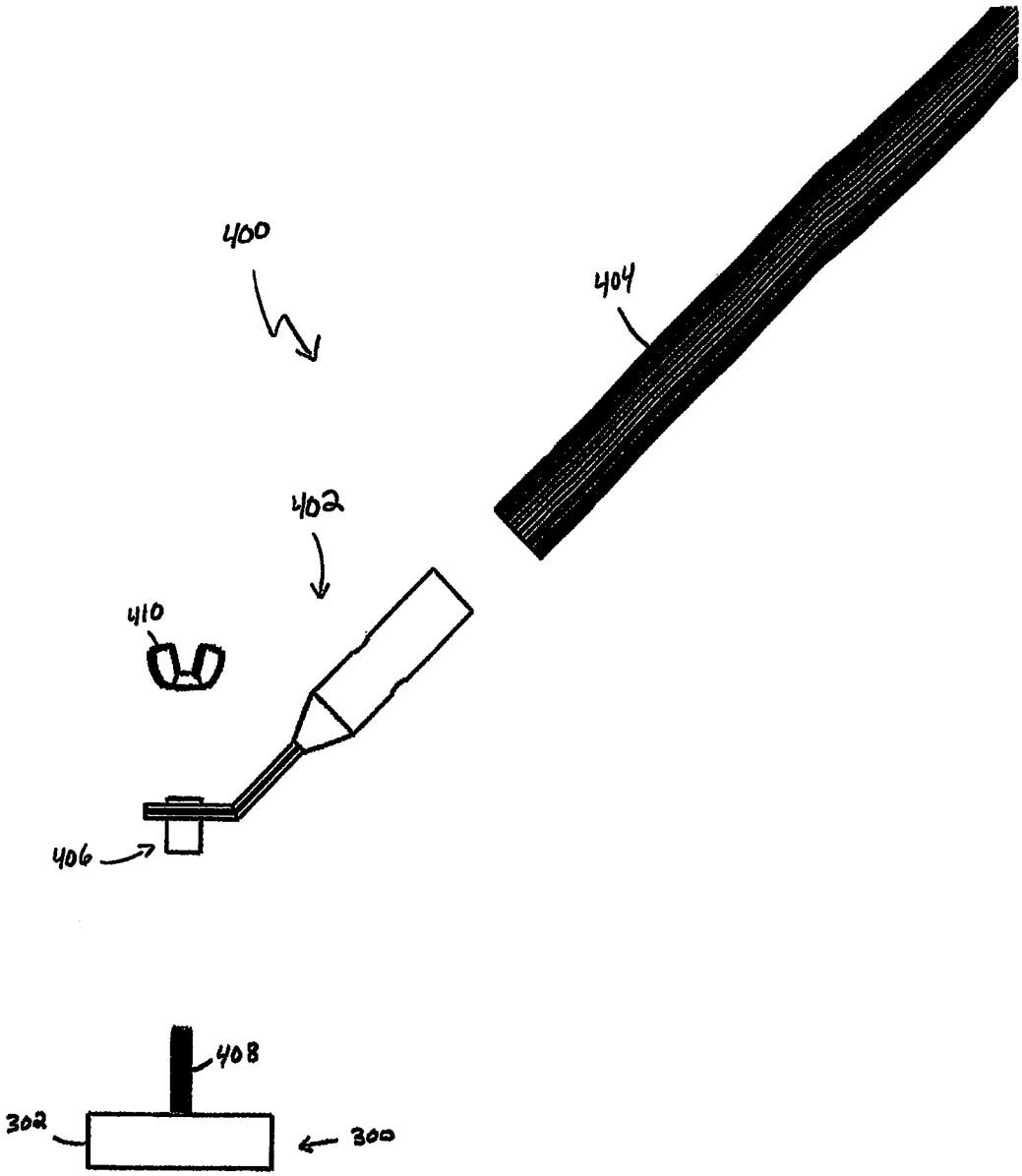
FIG. 16 is an exploded, elevation view of a coating applicator and a carrier in accordance with an embodiment of the present disclosure.

Referring to FIGS. 2E, 15, and 16, in one embodiment, the system of the present disclosure may also include an additional coating applicator 300 for the purpose of coating alternative hard to reach surfaces. For example, referring to FIGS. 1E and 2E, a substrate may include a protruding vertical element 112 and protruding horizontal element 114. A hard to reach surface area may be created when the contour of a surface to be coated contains such an overhanging protruding element projecting over the main surface. In some instances, such an overhanging protruding element, requires a second process to apply a coating to such an area. The coating applicator 300 can be used to perform this second process. Coating applicator 300 is adapted to reach, contact, and coat such areas that are covered by overhanging projections.

Referring to FIGS. 15 and 16, a coating applicator 300 for applying a coating to a substrate 100 includes a body 302. In one embodiment, the body 302 of the coating applicator 300 may include a first outer portion defined by an outer diameter and a second round portion defined by the outer diameter of the first outer portion.

Referring to FIGS. 15 and 16, the connection of the coating applicator 300 of the present disclosure to a carrier 400 will now be described. By connecting the coating applicator 300 to a carrier 400, a user is able to conveniently apply a coating or a liquid to a substrate. The carrier 400 includes a frame or applicator portion 402 and a handle portion 404 extending from the applicator portion 402. In one embodiment, the applicator portion 402 includes an axle housing 406 for rotatably receiving an axle 408 that is attached to the coating applicator 300 as shown in FIGS. 15 and 16. In one embodiment, a nap element is attached to the coating applicator 300 as described above. The axle housing 406 receives the axle 408 as shown in FIG. 15 and allows the coating applicator 300 to be rotated as the coating is applied to the above-described overhang area. In one embodiment, a fastener 410 can be used to rotatably secure the axle 408 to the axle housing 406 and the carrier 400 as shown in FIG. 15.

Referring to FIGS. 6, 7, 13, and 14, a variety of methods of manufacturing for a coating applicator of the present disclosure will now be described. The creation of a body of a coating applicator of the present disclosure can be achieved through a number of methods known by those skilled in the art.

In one embodiment, a method of forming a coating applicator may include the following steps: (1) selecting a first portion of substantially solid mass that can be formed to match a first contour of a substrate; (2) selecting a second portion of substantially solid mass that can be formed to match a second contour of a substrate; (3) engaging the first portion with a tool to form a first shape; (4) engaging the second portion with a tool to form a second shape; and (5) combining the first portion and the second portion to form a coating applicator that is adapted to cover a substrate having a first contour and a second contour. In one embodiment, a method of forming a coating applicator allows for a coating applicator to be custom-made to reach, contact, and cover with a coating the various shapes, angles, contours, diameters, or small variations thereof of a contoured substrate. In one embodiment, the coating applicator of the present disclosure is formed from one integral or homogeneous component.

In one embodiment, when the material of the body of a coating applicator is wood or plastic, the body may be shaped on a lathe. For example, referring to FIGS. 6 and 7, the diameter D1 of a first portion 24 of a body 22 can be formed to a first desired size and shape, e.g., a cylindrical shape. Next, tooling can engage the body 22 to cut or carve out material until a desired inner or second diameter D2 is formed to create the second portion 26 of the body 22 of the coating applicator 20. In one embodiment, tooling can then be used to form a third portion 36 of the body 22. For example, the third portion 36 may be a vertical or tapered portion between the first portion 24 and the second portion 26. In one embodiment, if the contour of the substrate has an angled portion, the third portion 36 of the body 22 may include a frustum shaped contoured portion.

Other methods of creating a body of a coating applicator can include a molded material where an outer mold is formed so that the body formed within the mold will result in the first portion 24, the second portion 26, and the third portion 36.

Referring to FIG. 13, the body 22 of a coating applicator 20 can also be created using separate sections. A body can be created, for example, by using three separate bodies or portions 26, 28, 30. A first section 28 of a cylindrical shape is located at a first end and a second section 30 is located at a second end. These two cylindrical shapes have a matching outer diameter. These two sections 28, 30 form the first portion 24 of the shape. The second portion 26 of the body is a third separate portion having a diameter that is different than the first portion 24. The second portion 26 of the body is the portion between the first section 28 and the second section 30. The second portion 26 may create a surface, or a third portion, that is either angled or perpendicular to both the first and second portions of the body. When these three bodies are assembled on a shaft or central spool 42, they create a body that can parallel a variety of different channeled substrates. In one embodiment, the central spool 42 may include a first spool end portion 46 and a second spool end portion 48 as shown in FIG. 13.

Figure 14:
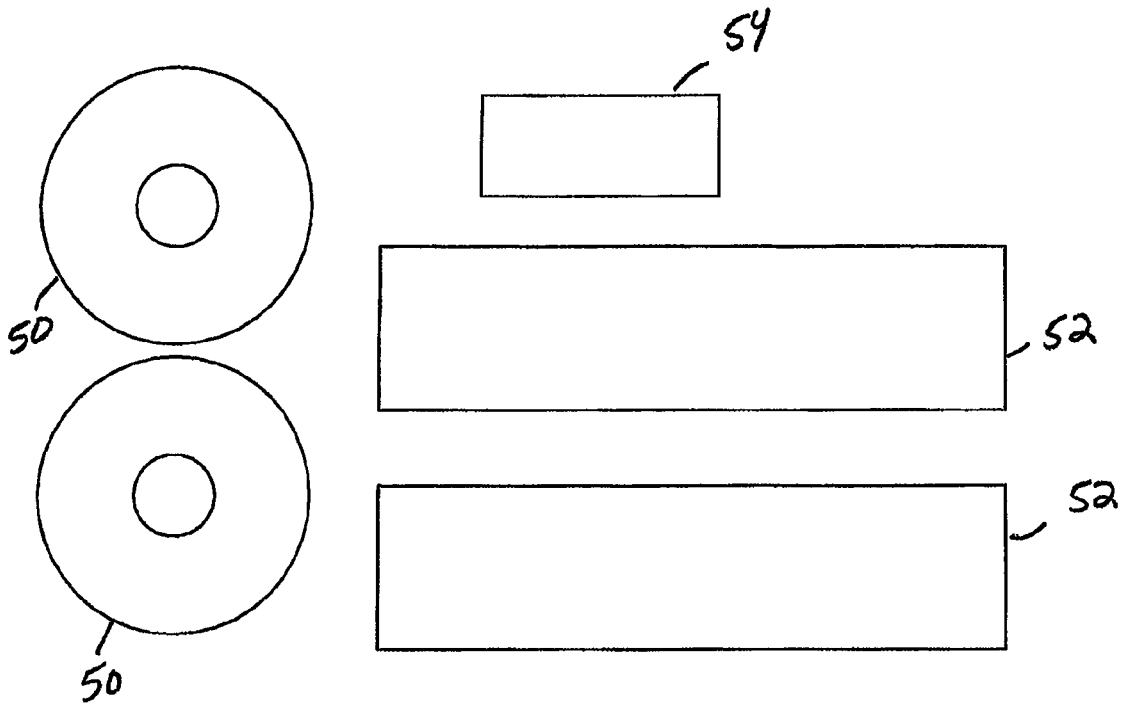
FIG. 14 is a top view of portions of a nap element for a coating applicator in accordance with an embodiment of the present disclosure.

In one embodiment, referring to FIG. 14, a nap material or element may then be attached to the first, second, and third portions of the body. This nap material may be cut or otherwise fabricated to fit the first, second, and third portions of the body. In other words, the nap material may be cut into a first shape 50, a second shape 52, and a third shape 54 as shown in FIG. 14. In one embodiment, the attachment process of the nap material may be done on the body after the entire body has been formed. Alternatively, when the body is assembled with a series of sections that create the first, second, and third portions, the nap can be attached prior to the assembling of the sections. In one embodiment, a method of forming a coating applicator may include forming sections of a nap element that are configured to conform to the geometric shapes of the coating applicator.

While this disclosure has been described as having exemplary designs, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. A coating application system for applying a coating to a substrate, comprising:

a carrier comprising a tank spreader;

a first coating applicator for applying the coating to the substrate, the first coating applicator removably attachable to the carrier, the first coating applicator comprising a first body having a first portion and a second portion, the first portion having a first diameter and the second portion having a second diameter different than the first diameter; and a second coating applicator for applying the coating to the substrate, the second coating applicator removably attachable to the carrier, the second coating applicator comprising a second body having a third portion and a fourth portion, the third portion having a third diameter and the fourth portion having a fourth diameter different than the third diameter.

2. The coating application system of claim 1, wherein the first diameter of the first portion of the first coating applicator is different than the third diameter of the third portion of the second coating applicator.

3. The coating application system of claim 2, wherein the second diameter of the second portion of the first coating applicator is different than the fourth diameter of the fourth portion of the second coating applicator.

4. The coating application system of claim 1, wherein the substrate has a first contoured surface and a second contoured surface different than the first contoured surface, the first portion of the first coating applicator is adapted to cover the first contoured surface of the substrate and the second portion of the first coating applicator is adapted to cover the second contoured surface of the substrate.

5. The coating application system of claim 1, wherein the substrate has a first contoured surface and a second contoured surface different than the first contoured surface, the third portion of the second coating applicator is adapted to cover the first contoured surface of the substrate and the fourth portion of the second coating applicator is adapted to cover the second contoured surface of the substrate.

6. A coating application system for applying a coating to a substrate, comprising:

a carrier comprising a tank spreader;

a first coating applicator for applying the coating to the substrate, the first coating applicator removably attachable to the carrier, the first coating applicator comprising a first body having a first portion and a second portion, the first portion having a first contoured surface and the second portion having a second contoured surface different than the first contoured surface; and a second coating applicator for applying the coating to the substrate, the second coating applicator removably attachable to the carrier, the second coating applicator comprising a second body having a third portion and a fourth portion, the third portion having a third contoured surface and the fourth portion having a fourth contoured surface different than the third contoured surface.

7. The coating application system of claim 6, wherein the first contoured surface of the first portion of the first coating applicator is different than the third contoured surface of the third portion of the second coating applicator.

8. The coating application system of claim 7, wherein the second contoured surface of the second portion of the first coating applicator is different than the fourth contoured surface of the fourth portion of the second coating applicator.

* * * * *